US008070138B2

(12) United States Patent
Saitou et al.

(10) Patent No.: US 8,070,138 B2
(45) Date of Patent: Dec. 6, 2011

(54) SAUNA APPARATUS

(75) Inventors: Kazuhiro Saitou, Aichi (JP); Yoshihiro Nishizuru, Aichi (JP)

(73) Assignee: Panasonic Corporation, Osaka (JP)

( * ) Notice: Subject to any disclaimer, the term of this patent is extended or adjusted under 35 U.S.C. 154(b) by 720 days.

(21) Appl. No.: 12/278,302

(22) PCT Filed: Mar. 12, 2007

(86) PCT No.: PCT/JP2007/054766

§ 371 (c)(1), (2), (4) Date: Aug. 5, 2008

(87) PCT Pub. No.: WO2007/108341

PCT Pub. Date: Sep. 27, 2007

(65) Prior Publication Data

US 2009/0049597 A1 Feb. 26, 2009

(30) Foreign Application Priority Data

Mar. 20, 2006 (JP) ..... 2006-076330

(51) Int. Cl.
*B01F 3/04* (2006.01)

(52) U.S. Cl. ..... 261/28; 261/78.2; 261/81; 4/524

(58) Field of Classification Search ..... 261/28, 261/78.2, 81, 111, 115; 4/524
See application file for complete search history.

(56) References Cited

U.S. PATENT DOCUMENTS 770,910 A * 9/1904 Keyling ..... 261/111
984,660 A * 2/1911 Haas ..... 261/111
997,430 A * 7/1911 Whittlesey ..... 261/29
1,730,866 A * 10/1929 Sternberg ..... 261/28
2,414,718 A * 1/1947 Christensen ..... 261/111
2,498,469 A * 2/1950 Petty ..... 96/360
3,467,813 A * 9/1969 Raabe ..... 392/391
4,712,538 A * 12/1987 Hardie et al. ..... 601/16

FOREIGN PATENT DOCUMENTS

| | | |
|---|---|---|
| JP | 55-152332 | * 11/1980 |
| JP | 2-264659 | 10/1990 |
| JP | 8-182733 | 7/1996 |
| JP | 8-215309 | 8/1996 |
| JP | 10-127768 | 5/1998 |
| JP | 2003-325635 | 11/2003 |
| JP | 2003-339817 | 12/2003 |
| JP | 2006-025966 | 2/2006 |
| JP | 2006-288712 | 10/2006 |

OTHER PUBLICATIONS

International Search Report issued Apr. 10, 2007 in the International (PCT) Application of which the present application is the U.S. National Stage.

* cited by examiner

*Primary Examiner* — Charles Bushey

(74) *Attorney, Agent, or Firm* — Wenderoth, Lind & Ponack, L.L.P.

(57) ABSTRACT

A sauna apparatus includes an air blower, a blow channel and a humidifier. The air blower suctions and blows air. The blow channel conveys the suctioned air and humidified air. The humidifier has a sprayer that sprays humidifying water into the air passing through the blow channel for humidification, and a spray-water droplet splitter installed in a direction to which the sprayer sprays the water for humidification. By letting the sprayed water droplets collide with the splitter, the water droplets are split into much finer water droplets.

5 Claims, 7 Drawing Sheets

FIG. 10 – PRIOR ART

SAUNA APPARATUS

This application is a U.S. National phase application of PCT International Application PCT/JP2007/054766, filed Mar. 12, 2007.

TECHNICAL FIELD

This invention relates to a sauna apparatus for heating and humidifying a room such as a bathroom, to thereby convert the room into a sauna space.

BACKGROUND ART

FIG. 10 is a schematic diagram showing a constitution of a conventional sauna apparatus. This type of sauna apparatus is disclosed in Unexamined Japanese Patent Publication No. H2-264659, for instance. A conventional sauna apparatus is described hereinafter.

The sauna apparatus has discharge port 102 and suction port 103 both opening into bathroom 101. Suction port 103 is communicated to discharge port 102 through blow channel 104. In blow channel 104, spray nozzle 105 (hereinafter, referred as 'nozzle') is installed. Nozzle 105 is connected to warm water supply 106. Cross flow fan 107 is installed at suction port 103.

Hot air generator 108 installed in a middle of blow channel 104 has case 109. Case 109 is provided with suctioned-air communication port 110, blow-air communication port 111, and drain port 112. Suctioned-air communication port 110 is communicated with the suction side of blow channel 104 and blow-air communication port 111 is communicated with the discharge side of blow channel 104. Inside case 109, a plurality of air flow directing plates 113 are disposed. Air flow directing plates 113 constitute meandering mixing room 114. Suctioned-air communication port 110 and blow-air communication port 111 are communicated to each other through meandering mixing room 114. Nozzle 105 is installed near the suctioned-air communication port 110 side rather than the meandering mixing mouth 114 side. In the sauna apparatus thus constituted, warm water spray sprayed by nozzle 105 is mixed with air in meandering mixing room 114. The air is thus humidified and heated and then sent into bathroom 101 through discharge port 102.

With this conventional sauna apparatus, when hot water is sprayed in blow channel 104, water droplets having a relatively large diameter are produced. Accordingly, the suctioned air is not efficiently humidified and an effective humidification amount is not obtained. For this reason, producing finer water droplets and sending out a much larger amount of the water droplets are required.

When water droplets of a large diameter are blown out from discharge port 102, a person in the bathroom feels unpleasant with the droplets. For this reason, it is desired to control generation of the large diameter droplets or collecting such droplets efficiently. In order to solve this task, a conventional constitution needs a countermeasure such as installing a plurality of air flow directing plates 113 of a large scale. However, such constitution increases air flow resistance, or makes the constitution complicated.

SUMMARY OF THE INVENTION

The present invention provides a sauna apparatus, which produces relatively tiny water droplets and increases humidity in a bathroom even with a method of spraying the droplets in a blow channel for increasing humidity. Having a relatively simple structure, it prevents large diameter droplets from being blown into the bathroom.

The sauna apparatus of the present invention includes an air blower, a blow channel, and a humidifier. The air blower suctions and blows air. The blow channel conveys the suctioned air and humidified air. The humidifier has a sprayer for spraying water for humidification into the air passing through the blow channel so as to humidify the air, and a spray-water droplet splitter. The spray-water droplet splitter is installed facing toward the sprayer that sprays the water for humidification. By letting the sprayed water droplets collide with the splitter, the water droplets are split into much finer water droplets. Since the spray-water droplet splitter splits fine water droplets sprayed by the sprayer into much finer droplets, the sauna apparatus of this invention increases efficiency of humidification, and does not blow out large diameter droplets.

BRIEF DESCRIPTION OF THE DRAWINGS

FIG. 10 is a block diagram of a conventional sauna apparatus.

DETAILED DESCRIPTION OF THE PREFERRED EMBODIMENTS

Figure 1:
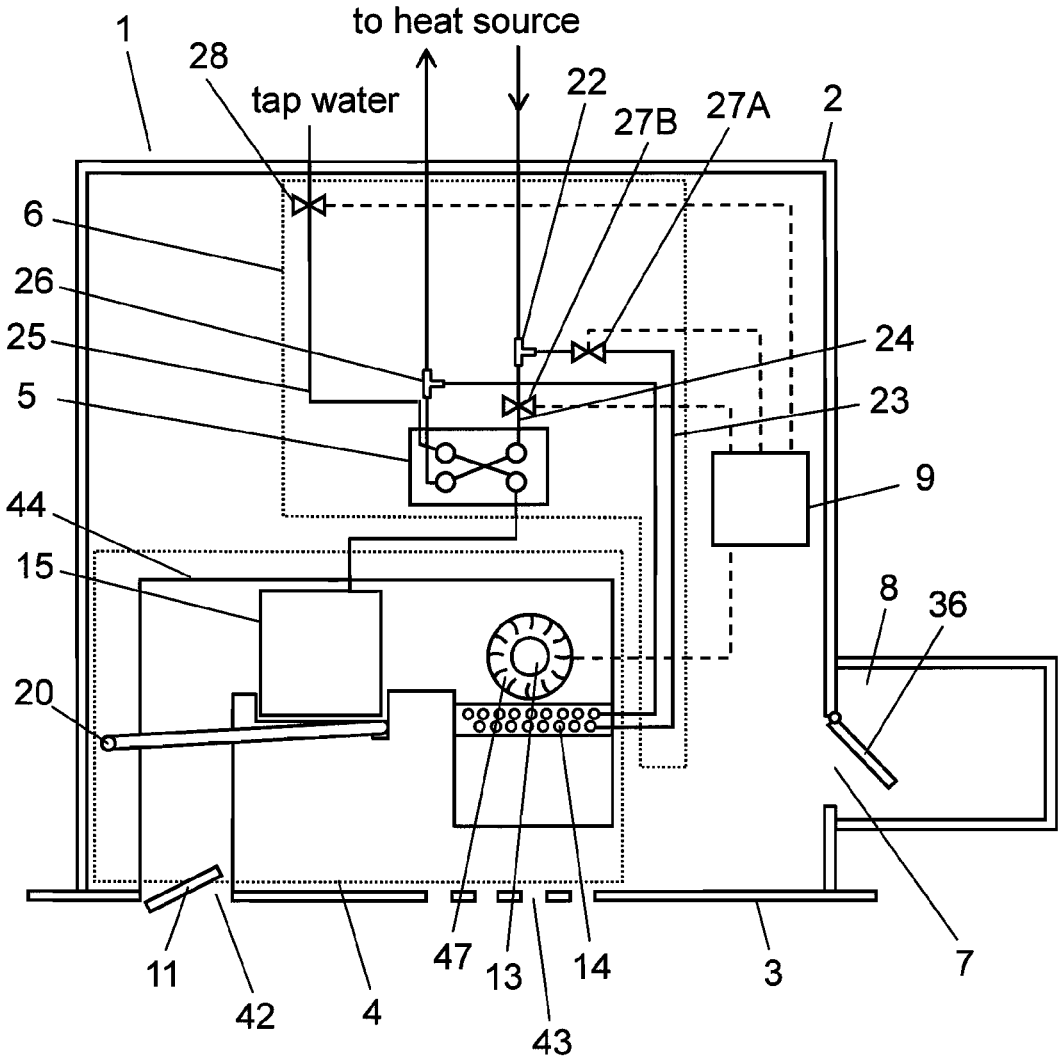
FIG. 1 is a block diagram showing a sauna apparatus in accordance with an embodiment of the present invention.

FIG. 1 is a block diagram schematically showing a sauna apparatus according to an embodiment of the present invention. Sauna apparatus 1 includes exterior package 2, front panel 3, sauna module 4, heat supplier 6, ventilation unit 8, and controller 9. Exterior package 2 constitutes an outer shell of sauna apparatus 1. Front panel 3 constitutes a wall of exterior package 2 adjacent to a bathroom. Sauna module 4 suctions air from the bathroom, heats and humidifies the air and then blows it out again to the bathroom. Heat supplier 6 includes plate heat exchanger 5. Ventilation unit 8 is installed at a side of exterior package 2 and is attached to opening 7 communicated to a blow channel. Controller 9 controls these constituent members. Hereinafter, each constitution is specifically described.

Figure 2:
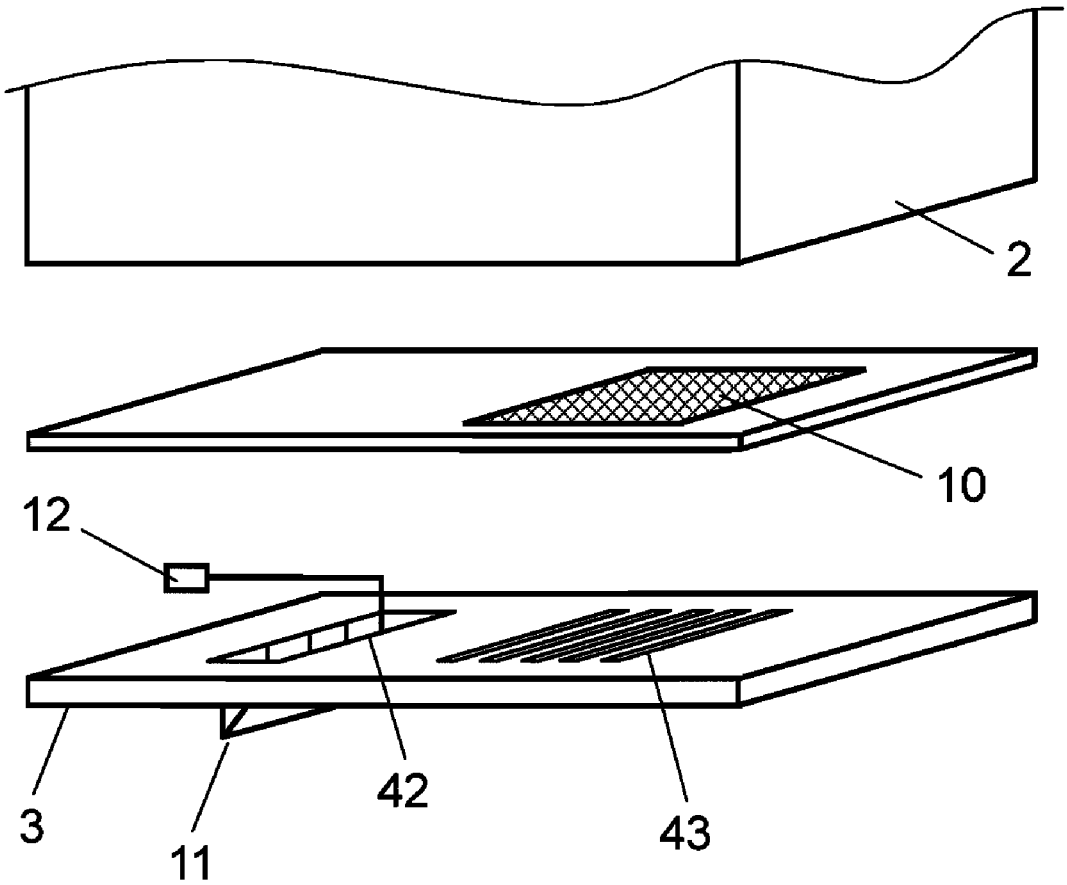
FIG. 2 is a schematic exploded view of the sauna apparatus in a state that a front panel is detached from the sauna apparatus shown in FIG. 1.

FIG. 2 is a schematic exploded view of the apparatus in a state in which front panel 3 is detached. Front panel 3 is provided with suction port 43 for suctioning air from the bathroom and discharge port 42 for blowing out the air heated and humidified out from sauna apparatus 1. At the sauna module 4 side of suction port 43, filter 10 is disposed. Filter 10 prevents minute dust and motes from coming into the module when the air in the bathroom is circulated. At discharge port 42, louver 11 is installed for changing a blowing direction of the heated and humidified air. Louver 11 is driven by louver-driving motor 12 connected to controller 9 shown in FIG. 1, variably changing the blow direction to an arbitrary direction.

Figure 3:
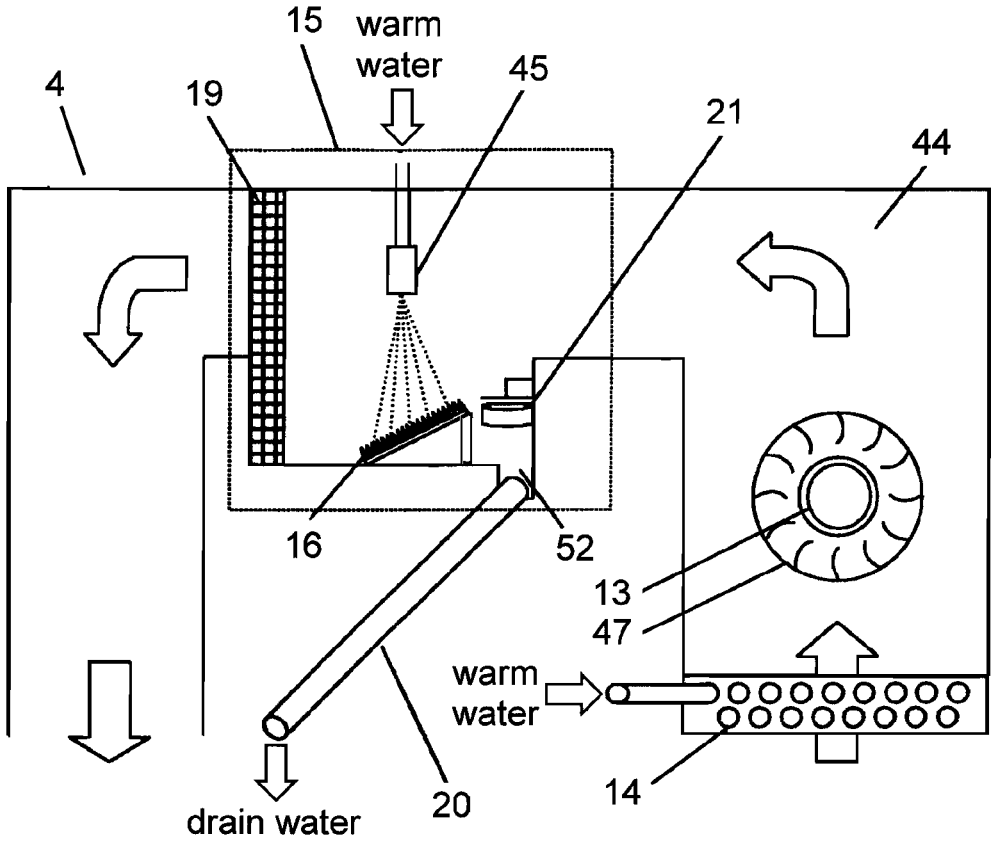
FIG. 3 is a block diagram of a sauna module of the sauna apparatus shown in FIG. 1.

FIG. 3 is a block diagram of sauna module 4. Inside sauna module 4, blow channel 44 is formed and communicates suction port 43 of front port 3 to discharge port 42. At the suction port 43 side of blow channel 44, cross flow fan 47 is installed as an air blower. Cross flow fan 47 is attached to motor 13 having a revolution rate that is arbitrarily changed by controller 9 shown in FIG. 1. As cross flow fan 47 rotates, air is suctioned through suction port 43 and is sent to sauna module 4 installed in blow channel 44. Blow channel 44 conveys the suctioned air as well as the air humidified by humidifier 15, which is described later.

Upstream of cross flow fan 47, coil 14, which is a heat exchanger, is disposed as an air heater. Heat supplier 6 shown in FIG. 1 supplies warm water to coil 14. With the warm water, the air suctioned from the bathroom is heated.

Downstream of cross flow fan 47 in blow channel 44, humidifier 15 is installed. Humidifier 15 includes jet nozzle (hereinafter, called 'nozzle') 45, spray-water droplet splitter (hereinafter, 'splitter') 16, and eliminator 19. Nozzle 45 is a sprayer for spraying water for humidification (humidifying water) into the air passing inside blow channel 44 and humidifies the air. Heat supplier 6 supplies nozzle 45 with warm water (40 to 80° C., for instance), and nozzle 45 atomizes the supplied warm water and sprays it as fine water droplets.

Splitter 16 is disposed in a direction in which nozzle 45 sprays the humidifying water. The sprayed water droplets collide with splitter 16 and are split into much finer droplets. Thus, the atomized water droplets sprayed by nozzle 45 are split into much finer water droplets. This constitution increases humidity, and prevents water droplets of a large diameter from being blown out.

Splitter 16, when installed in blow channel 44, is preferably structured having a slope with respect to a horizontal plane. Installed in this configuration, drainage is improved and surplus water does not stay in a place where the warm water sprayed by nozzle 45 collides with splitter 16. Therewith, a solid wall surface of splitter 16 is exposed, splitting water droplets without being obstructed by such surplus water. As described, an idealistic splitting is achieved at a contact surface between the atomized water droplets sprayed by nozzle 45 and splitter 16, increasing a degree of humidification. The larger the angle of the installation slope, the better becomes the splitting. By securing a slope of at least 5° preferably, the surplus water at the place where the warm sprayed water collides with splitter 16 is reliably drained. A surface of splitter 16 is preferably coated with a thin silicon film to secure water repellency. This treatment further improves drainage.

Figure 4:
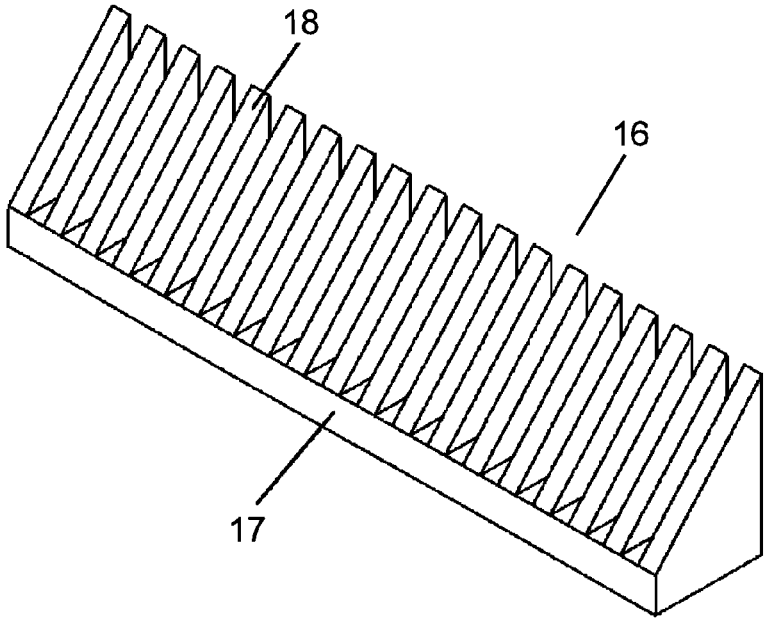
FIG. 4 is a perspective view of a spray-water droplet splitter of the sauna apparatus shown in FIG. 1.
Figure 5:
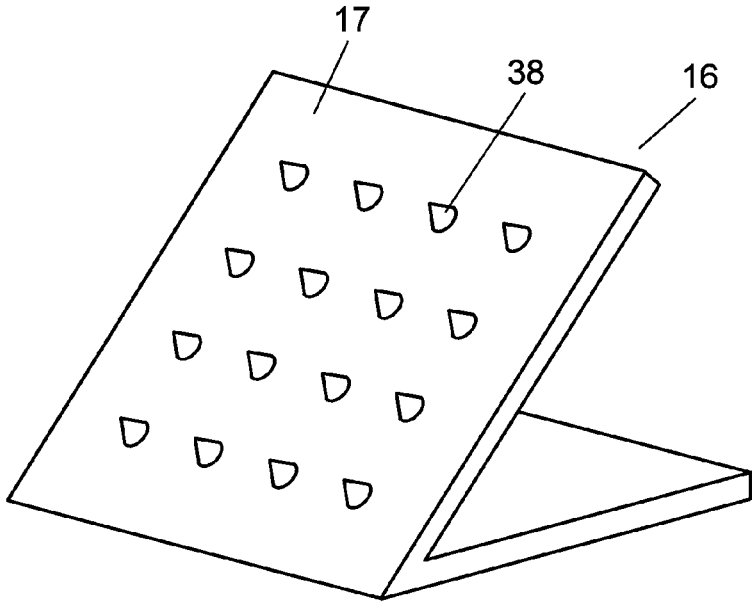
FIG. 5 is a perspective view of another spray-water droplet splitter of the sauna apparatus shown in FIG. 1.

FIGS. 4 and 5 are perspective views of splitter 16 showing constitutional examples. In FIG. 4, splitter 16 has flat board 17 and a plurality of flat plates 18. Each flat plate 18 is about 2 mm thick. Flat plates 18 are arranged on flat board 17 in a comb teeth shape having a teeth interval similar to the thickness of flat plate 18. The comb teeth shape makes drainage much better. By the blowing air passing through a space between the teeth, more of the fine water droplets are carried to discharge port 42. With this constitution, a side plane of flat plate 18 facing nozzle 45 has a slope with regard to a horizontal plane.

Splitter 16 shown in FIG. 5 has flat board 17 and a plurality of protrusions 38 in a conical shape. Each protrusion 38 is about 5 mm in radius and about 5 mm in height. They are raised from flat board 17. This configuration further improves drainage. As the warm water collides with protrusion 38, dispersion rate of the fine water droplets is improved after the collision and more of the fine water droplets are conveyed to discharge port 42. In this constitution, a plane of flat board 17 facing nozzle 45 has a slope with regard to a horizontal plane.

Vibrating splitter 16 with a frequency of 1 MHz to 3 MHz applied by an ultrasonic oscillator increases a relative velocity between a sprayed water droplet and splitter 16, enabling splitter 16 to split the water droplets into much finer droplets. Fine water droplets (with a diameter of at most 100 μm, for example) are conveyed to discharge port 42 with blown air, and serve to humidify a bathroom, while water droplets not split into finer droplets flow to drain port 52.

Among the fine water droplets conveyed by blown air, droplets having a relatively large diameter (10 to 100 μm, for example) are caught by eliminator 19 and are directed to drain port 52. Eliminator 19 is a water droplet collector disposed at the discharge port 42 side of humidifier 15. Fine water droplets (with a diameter of at most 10 μm) passed through eliminator 19 are sent to the bathroom through discharge port 42 with air heated by coil 14. Eliminator 19 is made of rough mesh material. It does not require a large-scale conventional meandering air duct having an air-flow directing plate, so pressure loss is relatively small.

Water directed to drain port 52 flows out of the apparatus through drain pipe 20 attached to drain port 52. Drain port 52 is provided at a lowest portion of humidifier 15 and a bottom of drain port 52 is preferably inclined so that a portion connected to drain pipe 20 is positioned at a lowest end. With this configuration, surplus water does not remain inside humidifier 15. The larger the inclination angle of the bottom, the better becomes drainage. With an inclination of at least 5°, the surplus water in humidifier 15 is securely drained off.

Drain pipe 20 is installed preferably having at least 5° of inclination to avoid having the surplus water remain in the apparatus. Drain port 52 is preferably equipped with float switch 21. Float switch 21 detects a rising water level in drain port 52 and when the water exceeds a prescribed level, controller 9 stops water supply to nozzle 45. Thus, leakage of water from humidifier 15 is prevented.

Figure 6:
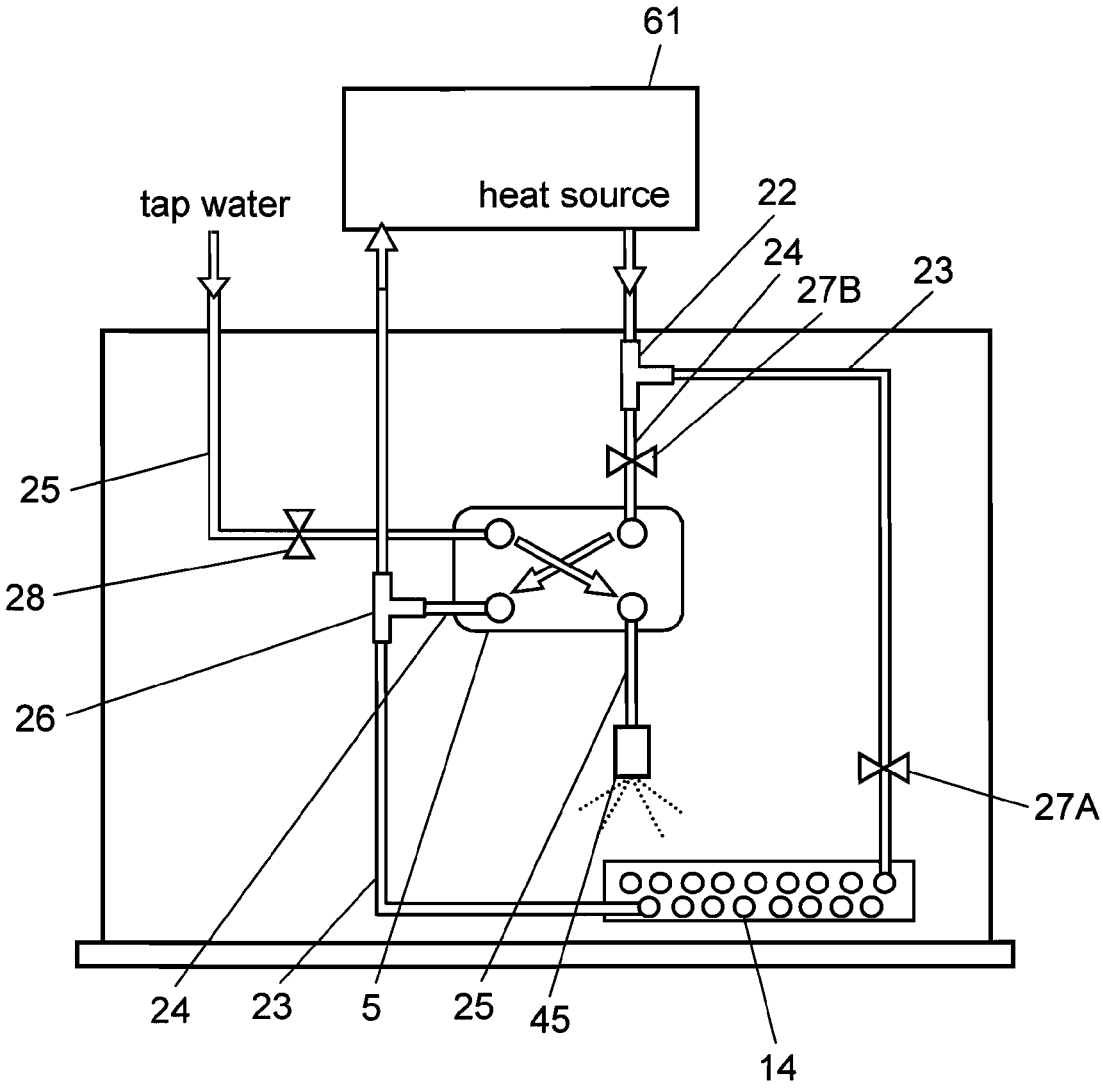
FIG. 6 is a block diagram of a heat supplier of the sauna apparatus shown in FIG. 1.

FIG. 6 is a schematic block diagram of heat supplier 6. Circulating warm water supplied by heat source 61 is divided at branch 22 into warm water circulating circuit 23 (hereinafter, 'circuit') for heating and warm water circulating circuit 24 (hereinafter, 'circuit') for humidifying. Circuit 23 is connected to coil 14 and heats coil 14, and circuit 24 is connected to plate heat exchanger 5 and heats plate heat exchanger 5.

Figure 7:
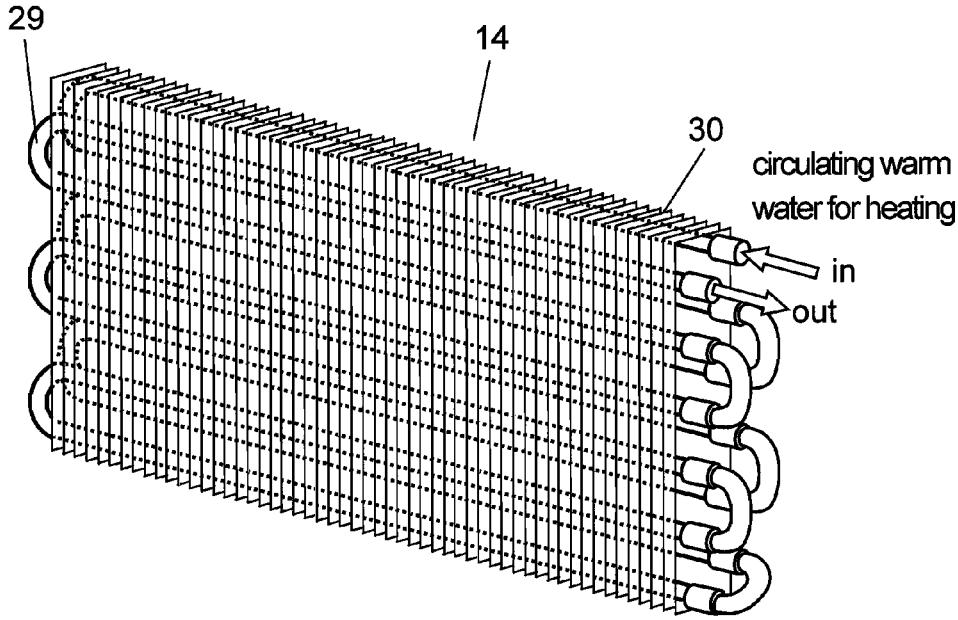
FIG. 7 is a perspective view of a coil in the heat supplier shown in FIG. 6

FIG. 7 is a perspective view of coil 14. Coil 14 includes aqueduct 29 for passing the circulating warm water for heating supplied by circuit 23, and fin 30 for transmitting heat and disposed on an outer wall of aqueduct 29. High temperature water flowing in aqueduct 29 heats fin 30. With flowing air in contact with fin 30, fin 30 exchanges heat with the air, so that the air is heated.

Figure 8:
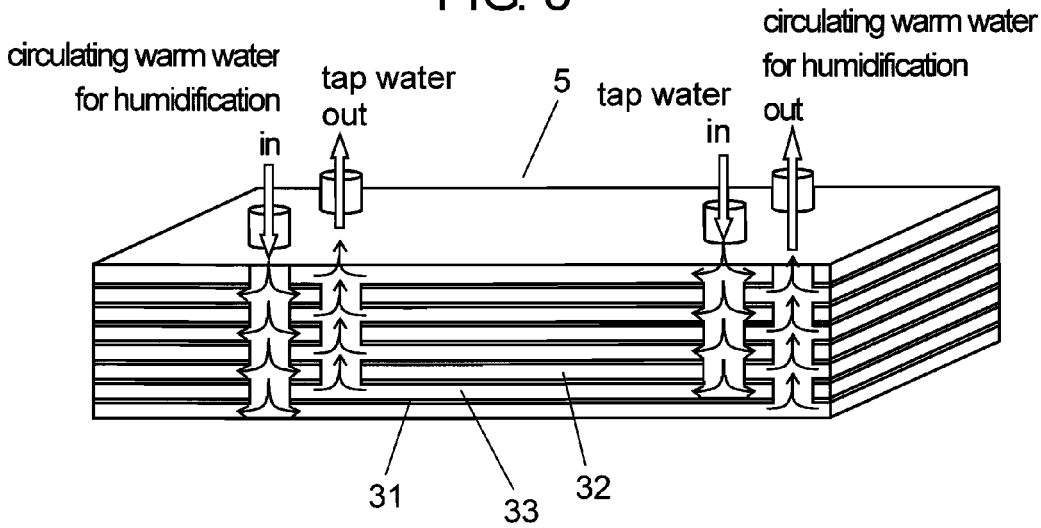
FIG. 8 is a schematic view of a plate heat exchanger of the heat supplier shown in FIG. 6.

FIG. 8 is a schematic view of plate heat exchanger 5. Plate heat exchanger 5 includes heat transmission wall 31, high temperature water channel 32 (hereinafter, 'channel') and low temperature water channel 33 (hereafter, 'channel'). Heat transmission wall 31 intercepts channel 32 and channel 33 alternately disposed. Circulating warm water for humidification flows in channel 32, and the humidifying water for humidification flows in channel 33 in an opposite direction to channel 32. As a result, the circulating warm water for humidification and the humidifying water exchange heat through heat transmission wall 31. The humidifying water, which is liquid at lower temperature, is heated up. The circulating warm water going out of coil 14 and the circulating warm water going out of plate heat exchanger 5 pass through circuits 23 and circuit 24, respectively, to come together at merger 26. The circulating warm water merged in a common channel returns to heat source 61, is heated again and repeatedly supplied.

Supplied tap water, which is the humidifying water flows through water feed channel 25 into channel 33 of plate heat exchanger 5. The tap water going out of plate heat exchanger 5 flows through water feed channel 25 into nozzle 45. Heated high temperature tap water in channel 25 is then sprayed by nozzle 45 to become the atomized fine warm water droplets and then blown into the bathroom together with warmed up air from the bathroom.

Warm water flowed through channel 23 into coil 14 exchanges heat in coil 14 with the air from the bathroom which cross-flow fan 47 conveys in blow channel 44. The air from the bathroom heated up to a high temperature is then blown back to the bathroom, warming up the inside of the bathroom.

As shown in FIG. 6, thermal valves 27A and 27B are preferably installed in circuits 23 and 24 for shutting off circulation of warm water. By adjusting a flow amount of circulating warm water to coil 14 and plate heat exchanger 5 by means of valves 27A and 27B, amounts of heating and humidification can be variable. Each thermal valve 27A or 27B is a type of valve, in which temperature of a valve holder linked to the valve body is raised by supplying electrical power, thereby swelling or deforming the valve holder and opening and closing the valve.

In a portion of water feed channel 25 in an upper stream of plate exchanger 5, electromagnetic valve 28 is preferably installed. By controlling an amount of supplied water by opening and closing electromagnetic valve 28; supply amount of humidifying water is variable. Electromagnetic valve 28 is a type of valve in which a valve utilizing electromagnetic force opens and closes with an electric signal.

Figure 9:
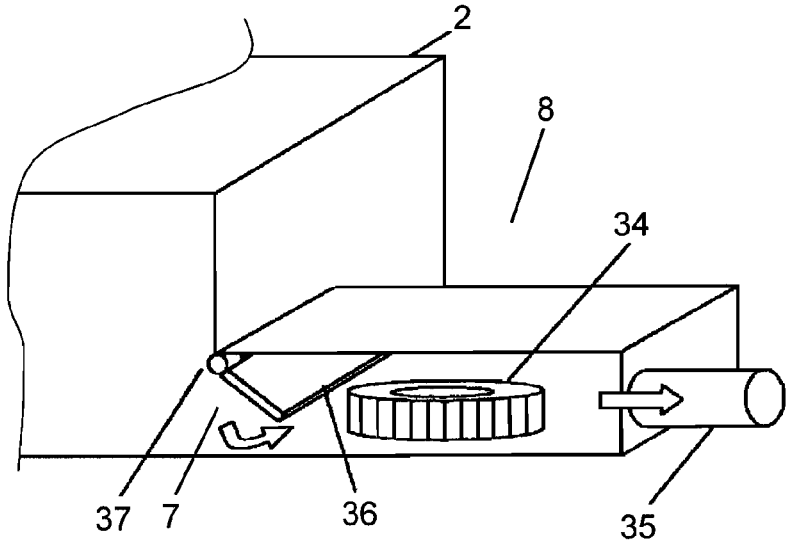
FIG. 9 is a schematic view of a ventilation unit of the sauna apparatus shown in FIG. 1.
Figure 9:
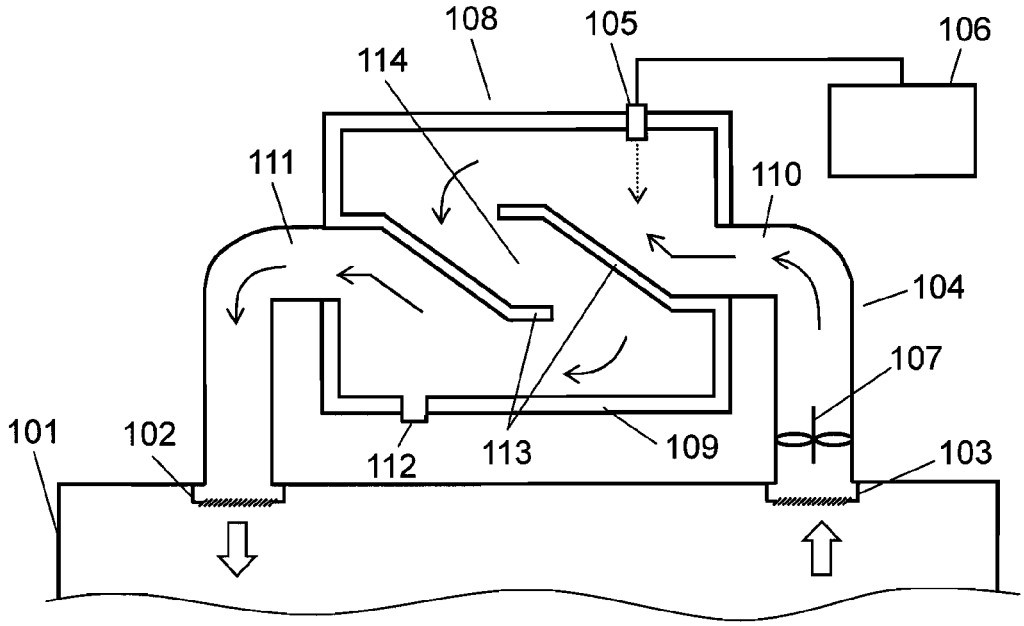

FIG. 9 is a schematic view of ventilation unit 8. Ventilation unit 8 includes ventilation fan 34, exhaust duct 35, and damper 36. Fan 34 suctions air from the bathroom through suction port 43 into ventilation unit 8. Duct 35 is an exhaustion channel for air. Damper 36 changes an open dimension of opening 7 formed at a side of exterior package 2. Ventilation unit 8 is attached to exterior package 2 via damper 36.

Damper 36 is opened and closed by damper-driving motor 37 connected to controller 9 in FIG. 1. During ordinary operation of the sauna, damper 36 is closed. When the bathroom is ventilated, controller 9 rotates fan 34 to open damper 36, drawing air from the bathroom through suction port 43 into ventilation unit 8, and then blowing out from exhaust duct 35. A ventilation amount is regulated by the opening dimension of damper 36 and a rotation rate of fan 34. An appropriate amount of ventilation is achieved with a combination of the two.

When the sauna apparatus is turned on, motor 13 in sauna module 4 starts moving, rotating cross flow fan 47 and suctioning air from the bathroom through suction port 43. The suctioned air passes through blow channel 44 and flows back to the bathroom through discharge port 42, thus circulated between the sauna apparatus and the inner space of the bathroom. At this time, controller 9 opens thermal valves 27A and 27B, which constitute a device for opening and closing circuits 23 and 24, and electromagnetic valve 28, which constitutes a device for opening and closing water feed channel 25, thus starting the heating and humidifying process in the apparatus. Then, louver 11 installed in front panel 3 is released, controlling a blowing direction of the heated and humidified air.

Although it is not illustrated, a sensor for detecting temperature and humidity in the bathroom is connected to controller 9. After a certain period of time, when the temperature and humidity in the bathroom reach respective predetermined values, controller 9 changes the rotation rate of motor 13, thereby changing a degree of heat and humidity.

Later, when the temperature and humidity in the bathroom exceed respective predetermined values still after a certain period of time, controller 9 changes the rotation rate of motor 13, so as to control the temperature and humidity inside the bathroom. By repeating the opening and closing process of thermal valves 27A, 27B and electromagnetic valve 28, controller 9 controls the temperature and humidity in the bathroom.

When turning off the sauna, controller 9 stops rotation of motor 13, and closes thermal valves 27A, 27B and electromagnetic valve 28. Then, controller 9 ventilates the bathroom for drying. For ventilating, controller 9 opens damper 36 and rotates fan 34. With this series of operations, the bathroom air suctioned through suction port 43 is exhausted through exhaust duct 35 to outside the bathroom.

By executing the above described procedures, the inside of the bathroom, which is a sauna object room, attains a state of high temperature and high humidity (about 40° C. and 80%), namely a mist sauna state which induces perspiration of a person in a sauna room. By providing the aforementioned humidifier 15, water droplets of a large diameter are collectively removed in blow channel 44 and only droplets of relatively a small diameter are blown into the bathroom, without assembling a large scale apparatus like a conventional meandering air duct.

In this embodiment, a bathroom is described as a sauna object room. However, the object room is not limited to a bathroom. As long as a dew condensation problem in a high humidity space is resolved, a sauna exclusive space can be prepared, causing no difference in its operational effect.

Rotation rate of motor 13 is arbitrarily changed by controller 9, but it is not limited to being changeable. As long as it is possible for motor 13 to switch to at least two rotation rates, no difference is caused in its operational effect. Preferably, rotation rate of motor 13 is linearly changeable to a desired rate. In a case in which the apparatus is operated under a fixed condition without changing, a motor with a fixed rotation rate is allowed, causing no difference in its operational effect.

In this embodiment, cross flow fan 47 is used as an air blower suctioning air from a bathroom and blowing into channel 44, but the air blower is not limited to a cross flow fan. Another type of fan including a sirocco fan, a turbo fan or a propel fan can be used without a problem as long as it satisfies conditions including air flow, power consumption, noise and vibration, causing no difference in its operational effect.

In this embodiment, a fin tube type coil 14 is used as a heating device for heating the air to be blown. However, the arrangement is not restrictive. Another type of heater can be used as long as it adequately heats up the air to be blown. A heater or other heat source can be placed in front of cross flow fan 47, causing no difference in its operational effect. Warm water is supplied by heat source 51 to circuits 23 and 24, but the arrangement is not restrictive. Refrigerant such as carbon hydride and halogenated hydrocarbon commonly used for an air conditioner or a refrigerator, or aqueous solution added by boiling point raising agent can be utilized.

In this embodiment, warm water is sprayed inside humidifier 15 for humidification. However, this constitution is not restrictive. When a bathroom is small (around 1.7 $m^2$) and does not require a large amount of humid, tap water at a normal temperature (around 20° C.) can be utilized without causing a difference in its operational effect. Humidifying water sprayed by nozzle 45 is preferably set at an appropriate temperature so that the bathroom is kept within a target temperature range and a target humidity range depending on a size of the bathroom, an atmospheric temperature outside the bathroom, and other conditions.

Splitter 16 shown in FIG. 4 is in a comb teeth shape, in which about 2 mm thick flat plates 18 are formed on flat board 17 with a space between the plates about the same as the thickness of flat plate 18. The shape is, however, not limited to the comb teeth. As long as good drainage and air-permeability between flat plates 18 are assured, there is no problem. Even if splitter 16 is formed with flat plates having a different thickness, no difference is caused in its operational effect.

Splitter 16 shown in FIG. 5 has protrusions 38 in a conical shape about 5 mm in radius and about 5 mm in height raised on flat board 17. But the shape is not limited to the conical shape. As long as diffusion rate of fine water droplet is improved when warm water droplet sprayed by nozzle 45 collides with protrusion 38, other shapes cause no problem. Protrusions 38 can be raised shapes such as a hemisphere shape or a pyramid, for example, causing no difference in their operational effect.

In this embodiment, a silicon thin film is deposited on a surface of splitter 16 for obtaining water repellency, but material for deposition is not restrictive. Another material can be used as long as it prevents surplus water from staying where warm water sprayed by nozzle 45 collides with splitter 16. For examples, a thin film of polytetrafluoroethylene or other fluorine resin can be deposited, or splitter 16 itself can be made of a water repellent resin, causing no problem and no difference in its operational effect. Water repellency is represented by a contact angle of a subject material against distilled water. By definition, the contact angle is at most 180°, so water repellent material having a contact angle of at least 90° but less than 180° against distilled water is preferably used at least on a surface of splitter 16. A super water repellent material having a contact angle of at least 110° against distilled water is most preferable.

Splitter 16 is vibrated with a frequency of 1 MHz to 3 MHz applied by an ultrasonic oscillator, but the frequency is not limited to this bandwidth. A frequency other than the bandwidth is applicable as long as it helps to split water droplets down to a necessary size. Another method including a method using a motor or a linear driving method can be used without a problem, causing no difference in its operational effect.

In this embodiment, a diameter of water droplets passing through eliminator 19 is specified to be at most 10 μm, but the dimension of the diameter is not restrictive. The diameter of water droplets passing through eliminator 19 can be at most 100 μm, but it is desirable that water droplets that pass through eliminator 19 and are supplied to a bathroom have a certain diameter such that a person in the bathroom does not get the feeling of water droplets. Generally, with a droplet diameter controlled under about 10 μm, most people do not get the feeling of water droplets while taking a bath.

In this embodiment, plate heat exchanger 5 is used as a heat exchanger, but it is not restrictive. As long as heat is exchanged efficiently, another type of heat exchanger such as a double tube type or a shell tube type can be used without a problem, causing no difference in its operational effect.

In the embodiment, a public water supply is utilized as a supply source of humidifying water, and a water pipe is directly coupled with the apparatus. However, this arrangement is not restrictive. When water pressure needs to be raised, pressure can be applied by a pump or the like to supply the humidifying water without a problem and causing no change in the operational effect.

Thermal valves 27A and 27B are used as opening and closing devices of circuits 23 and 24, but the devices are not restricted to the thermal type. Another type can be used without a problem as long as they open and close circuits 23 and 24. For instance, electromagnetic valve 28 can be used without causing a difference in the operational effect. A flow amount control valve is preferable such that controller 9 can control temperature and humidity, and which is highly responsive to a control signal.

Electromagnetic valve 28 is used as an opening and closing device of water feed channel 25, but the device is not restricted to this type. Another device can be used without a problem as long as it opens and closes water feed channel 25. A thermal valve can be used instead of electromagnetic valve 28 without causing a difference in its operational effect. A flow amount control valve is preferable such that controller 9 controls temperature and humidity, and which is highly responsive to a control signal.

A sauna apparatus according to the present invention produces relatively tiny water droplets and increases humidity even with a method of spraying the droplets in a blow channel for humidification. With this kind of a relatively simple structure, the invention sufficiently humidifies the inside of a bathroom without blowing large diameter droplets into the bathroom thereby giving an unpleasant feeling to a person in the bathroom. Accordingly, the invention is suitable for a sauna object room, typically a bathroom. By using this apparatus in combination with an air conditioning and ventilating apparatus for a living room other than for a bathroom, the apparatus can be used for heating and humidifying a living room.

The invention claimed is:

1. A sauna apparatus comprising:

an air blower capable of suctioning and blowing air;

a blow channel configured to convey the suctioned air and humidified air; and a humidifier including a sprayer capable of spraying water for humidification into air passing through the blow channel for humidification, and a spray-water droplet splitter installed in a direction to which the sprayer sprays the water for humidification, the splitter configured to make a sprayed water droplet much finer by colliding the sprayed water droplet with the splitter, wherein the spray-water droplet splitter vibrates.

2. The sauna apparatus according to claim 1, wherein the spray-water droplet splitter is constituted having a slope with regard to a horizontal plane.

3. The sauna apparatus according to claim 1, wherein the spray-water droplet splitter is in a comb shape having teeth.

4. The sauna apparatus according to claim 1, wherein the spray-water droplet splitter is constituted having protrusions raised from a flat board.

5. The sauna apparatus according to claim 1, wherein a surface of the spray-water droplet splitter has water repellency.

* * * * *